US010577787B2

(12) United States Patent
Ovrum

(10) Patent No.: US 10,577,787 B2
(45) Date of Patent: Mar. 3, 2020

(54) BEAM COMPONENT FOR USE IN TECHNICAL CONSTRUCTION, CONSTRUCTION KIT AND METHOD OF CONNECTING BEAM COMPONENTS

(71) Applicant: UAB Aldrea, Panevezys (LT)

(72) Inventor: Lars Ovrum, Kristiansand (NO)

(73) Assignee: UAB Aldrea, Panevezys (LT)

( * ) Notice: Subject to any disclaimer, the term of this patent is extended or adjusted under 35 U.S.C. 154(b) by 0 days.

(21) Appl. No.: 15/580,258

(22) PCT Filed: Jul. 21, 2015

(86) PCT No.: PCT/IB2015/055523

§ 371 (c)(1),
(2) Date: Dec. 6, 2017

(87) PCT Pub. No.: WO2016/198926

PCT Pub. Date: Dec. 15, 2016

(65) Prior Publication Data

US 2018/0155920 A1 Jun. 7, 2018

(30) Foreign Application Priority Data

Jun. 10, 2015 (LT) ..... 2015 044

(51) Int. Cl.

| | |
|---|---|
| ***E04B 1/24*** | (2006.01) |
| ***A47B 96/14*** | (2006.01) |
| ***A63H 33/12*** | (2006.01) |
| ***E04C 3/28*** | (2006.01) |
| ***E04B 1/28*** | (2006.01) |

(Continued)

(52) U.S. Cl.

CPC ..... *E04B 1/2403* (2013.01); *A47B 96/1408* (2013.01); *A63H 33/12* (2013.01); *E04B 1/28* (2013.01); *E04C 3/08* (2013.01); *E04C 3/28* (2013.01); *E04B 2001/2415* (2013.01); *E04B 2001/2469* (2013.01); *E04C 2003/0421* (2013.01); *E04C 2003/0452* (2013.01)

(58) Field of Classification Search

CPC ..... E04B 1/24; E04B 2001/2415; E04B 2001/2448; E04B 2001/2469; E04B 2/60; E04B 5/10; E04C 3/08; E04C 3/09; E04C 3/086; E04C 3/083; A47B 96/1408

See application file for complete search history.

(56) References Cited

U.S. PATENT DOCUMENTS

| | | | |
|---|---|---|---|
| 1,763,300 | A | 6/1930 | Gilbert |
| 2,301,306 | A | 11/1942 | McDonald |

(Continued)

FOREIGN PATENT DOCUMENTS

| | | |
|---|---|---|
| GB | 476867 | 12/1937 |
| GB | 827035 | 2/1960 |
| WO | 2002066760 | 8/2002 |

OTHER PUBLICATIONS

International Search Report dated Mar. 2, 2016.

*Primary Examiner* — Gisele D Ford
(74) *Attorney, Agent, or Firm* — Lowenstein Sandler LLP

(57) ABSTRACT

The present invention discloses the components and kit for technical construction method of sturdy and permanent connection up to six beam components perpendicularly, while none of the nodal joint structure protrudes outside the open channel(s) of the beam component(s). The method is user friendly during assembling.

9 Claims, 7 Drawing Sheets

(51) Int. Cl.
*E04C 3/08* (2006.01)
*E04C 3/04* (2006.01)

(56) References Cited

U.S. PATENT DOCUMENTS 3,019,866 A * 2/1962 Grabowski ..... A47B 96/1408 403/4
3,123,185 A * 3/1964 Van Der Rijst .... A47B 96/1408 52/633
3,648,426 A * 3/1972 Chaudhary ..... A47B 96/1408 52/633
3,845,601 A * 11/1974 Kostecky ..... E04B 1/2403 403/242
3,999,350 A * 12/1976 MacKenzie ..... A47B 96/1408 52/633
4,697,393 A * 10/1987 Madray ..... E04B 1/24 403/171
4,720,957 A * 1/1988 Madray ..... E04B 1/24 52/846
5,927,041 A * 7/1999 Sedlmeier ..... E04B 9/064 248/49
6,023,902 A * 2/2000 So ..... E04C 5/06 249/214
6,708,459 B2 * 3/2004 Bodnar ..... E04C 2/384 52/335
D598,219 S * 8/2009 Sparks, Jr. ..... D8/349
7,765,771 B2 * 8/2010 Serpico ..... E04B 1/24 52/241
10,151,100 B2 * 12/2018 McDonald ..... E04C 3/083
2005/0005561 A1 * 1/2005 Hanson ..... E04B 1/24 52/633
2006/0150548 A1 * 7/2006 Bodnar ..... E04B 5/10 52/262
2008/0006002 A1 * 1/2008 Strickland ..... E04C 3/07 52/843
2009/0205285 A1 * 8/2009 Jendusa ..... E04B 5/263 52/650.3
2009/0249743 A1 * 10/2009 Bodnar ..... E04C 3/09 52/846
2010/0037551 A1 * 2/2010 Bodnar ..... E04B 5/04 52/634
2012/0047834 A1 * 3/2012 Stal ..... B21D 47/01 52/356
2013/0180190 A1 * 7/2013 Bovet ..... E04B 1/24 52/220.1
2013/0187308 A1 * 7/2013 Stal ..... E04B 1/24 264/279
2014/0130441 A1 * 5/2014 Sugihara ..... E04B 1/2403 52/656.9
2015/0267393 A1 * 9/2015 Bovet ..... E04F 13/0866 52/126.3
2016/0002909 A1 * 1/2016 Bowron ..... E04B 1/3483 52/125.2

* cited by examiner

A1

A2

B

A

B

C

BEAM COMPONENT FOR USE IN TECHNICAL CONSTRUCTION, CONSTRUCTION KIT AND METHOD OF CONNECTING BEAM COMPONENTS

CROSS-REFERENCE TO RELATED APPLICATIONS

This application is a national stage entry under 35 U.S.C. § 371 of International Application No. PCT/IB2015/055523, filed Jul. 21, 2015, which claims the benefit of priority of LT Application No. 2015 044, filed Jun. 10, 2015, the disclosures of which are hereby incorporated by reference herein in their entirety.

FIELD OF THE INVENTION

The present invention relates to a beam designed for use in technical construction, kit for technical constructions comprising proposed beam components and fixing elements, necessary for method of connecting up to 6 said beam components in perpendicular directions.

The proposed components, kit and method can be used in new products, constructed from such components, namely forming the structural frameworks and models for small series production and for hobby. The models built may be used as a durable construction and support for further electronic equipment and modules as well as for additional mechanical parts being not elements of structural framework.

The principal design of beam component and fashion corner brackets as well as method of connecting of components according to present invention can also be used for building applications and structures used for exhibition boots, advertising signs, shelves for storage, laboratory instruments setups electrical component rack solutions, robotics etc.

BACKGROUND OF THE INVENTION

As from year 1901 the conception of educational toys was developed by Frank Hornby and MECCANO company (for example patent applications GB1190100587A, publ. 1901; U.S. Pat. No. 1,166,688A, publ. 1916; U.S. Pat. No. 1,202,388A, publ. 1916; etc.). The Meccano system uses bolts and nuts for connection of construction components, but is not suitable for constructions that requires a simple way of building with beams in many axes in space. It is especially complicated when assembling in small spaces.

Currently existing building and construction kits uses different approaches for joining parts together.

The Lego system [www.lego.com and referencing to the patent applications, for example U.S. Pat. No. 3,005,282(A), publ. 24.10.1961, U.S. design patent D384986, issued 14 Oct. 1997, etc.] has building bricks that uses buttons interlocking with friction, tight fitting to each other.

Much the same method is used in the Lego Technic system.

The disadvantages of LEGO system are the following:

- the components are generally based on pre-made parts, for the number of joints in a corner and for the length of the beams;
- many different complicated parts are to be present in the set to make the different connections possible;
- the system relies on snap connection to hold together beams, which make it less stable and less durable under the stress;

- a 6-direction connection joint of beams in a practical and durable way is not possible to realize with LEGO system elements.

Some principally similar methods for joining of beam components, based on snap connection or tap and notch fittings to provide a framework, are typically used for both educational/toys constructions and for more serious technical constructions, e.g. for connecting of vertical columns or detachable joined vertical columns (U.S. Pat. Nos. 3,002,315A, 3,132,443A, 4,624,383A, etc.) and/or connecting with horizontal beams (U.S. Pat. Nos. 3,168,793A, 3,890,738A, etc.), sometimes with the help of joining brackets or similar connection bodies (as in U.S. Pat. No. 8,011,156B1, EP0867593A2, GB1526058A—see FIG. 1 B).

Use of snap connections makes the set up construction less stable and durable under stress, therefore the models resulted could be used in very favourable conditions only. All beams must be produced in pre-made length and consumer cannot change the length of beams, for example, because the beam components have special surfaces for connection one with another. Therefore the models made of such construction set could not always convey the scale factor.

Methods that uses tap and notch fittings usually also requires pre-made lengths of beams and also often are not giving the required strength of the construction.

In building constructions it is also known the use of collar-form nodal joint between the ends of beam and the outside of a vertical column (U.S. Pat. No. 8,782,994B1).

Main disadvantages of such nodal joint: the collars will also take volume from outside a beams outer volumes, and has to be made in many different varieties to get all connection combinations desired. It can rather not be retro-fitted without disassembly of parts, when additional beams or components should be added. It also doesn't give itself to a method of holding the nuts in place before fastening.

Conventional components for technical constructions usually contain beams and fixing components that are residing outside the beams themselves, such as triangular shaped components fastened inside the corner of two beams or profiles that are to be joined.

Connection arrangement disclosed in EP1441081B1, publ. 2004 is used for connection of two profiles perpendicularly with the corner fixing element of two opposite triangle plates, having intermediate piece between plates (FIG. 1, A1). Such triangle element is designed to be engaged into the corner of two crossing profiles and fixed with at least one screw. Fixing element in the form of interlocking triangle component for reinforcement and secure a corner joint of game construction roads to be connected is disclosed in EP155451A2, publ. 1985. This interlocking component has undercuts on its sides to be embedded into longitudinal grooves on the rods mentioned and is fully protruding outside the groove(s) on the rods (FIG. 1 A2).

As can be seen, the triangle fixing elements known often reinforce a corner joint and give a sturdy enough joining method, but they are taking volume from outside the beams themselves. Because of that, the space for other parts of the construction will be diminished and therefore such system is rather not suitable for small constructions.

Especially when fixing more than two beams together in one joining center (nodal joint), each new beam introduced will require equally more space outside the beams perimeter. In joining methods that relies on fixing components positioned outside the beams, these will often have nuts that must be held in position until the bolt or screw is entered the threads, where the way the fixing elements are shaped is decisive to allow them stay in place inside the beams during assembly.

Summarizing, the main disadvantages of known prior art are loose and weak joints, resulting in not sufficient durability of construction. Another shortcoming is protruding of fixing elements substantially outside of components to be joined, complicating further mounting of additional parts and equipment.

Therefore the objective of the present invention is to provide a beam component for use in technical construction, a kit and method of connecting of beam components, allowing to provide as much space as possible for adding electronic equipment and additional mechanical parts and able to withstand harder loads and strains than existing construction kits have been able to offer. It is also important, that method of connection and forming of nodal joints in technical construction be user friendly, for example being easy for fitting in of small components at their place inside the nodal joint, thus freeing one hand for the assembly work.

DISCLOSURE OF THE INVENTION

Summary of the Invention

The principal object of the present invention is specially designed beam component for use in technical construction, comprising at least one flange and a web, delimiting open space or open channels on both sides of a web, which is perforated along its entire length, wherein the web is perforated with evenly spaced circular holes and at least one flange is perforated with at least two parallel lines of rectangular holes.

The open channel in the present application is defined as the volume between the flanges and the web, outside the beams material, thus forming a cuboid volume.

In the preferable embodiment of present invention the beam component is I-beam, wherein at least one flange is perforated with two parallel lines of rectangular holes and a distance between two parallel lines of rectangular holes corresponds to the thickness of a web, substantially in accordance with that shown in FIG. 2.

The centers of rectangular holes of the flange lie on the same plane with the center of each or each uneven circular hole on the web.

In the preferable embodiment of present invention the ratio of the thickness of the flange and depth and width of said open channel or open space is 1:2:3, substantially in accordance with that shown in FIG. 3.

Another important object of present invention is a kit for technical construction containing a plurality of beam components and fixing elements, wherein a beam component is the beam component as defined above, and fixing elements comprise a plurality of rectangular brackets, a plurality of fashioned corner brackets and fastening elements, preferably bolts and nuts.

Rectangular brackets of the kit according to present invention are each bearing evenly spaced circular holes, wherein distance between the circular holes in rectangular brackets corresponds the distance between the circular holes on web of said beam component, substantially in accordance with that shown in FIG. 4.

Special fashioned corner brackets of the present invention are step-shaped corner brackets, preferably with W/M profiled central corner and circular holes on its outer side edges, substantially in accordance with that shown in FIG. 6, designed to fit into the open channels of perpendicularly crossed beam components and to be fixed therein.

Rectangular brackets and rectangular nuts of present invention are designed to fit into rectangular holes of said beam component, and the fashioned corner bracket(s), bolts and rectangular nuts are designed to fit into corresponding open channels at the web; each said element not protruding outside the open channel(s) of beam component, being completely mounted.

Part of rectangular nuts in the construction kit of present invention are square nuts.

One more major object of present invention is a method of connecting of beam components perpendicularly, wherein for obtaining two-direction joint this method comprises:

a) providing a kit for technical construction mentioned, comprising at least first and second beam components, defined above;

b) putting a first beam component on one of its flanges;

c) inserting a rectangular bracket through the frontal rectangular hole of first beam component into a position, wherein center of lower hole of said bracket and of a circular hole on web of said first beam component match the same axis;

d) adding the second beam component, facing the open channels of both beam components to same side and forming an assembly unit, connecting said beam components at right corner by fitting the upper part of said rectangular bracket, inserted through a lower rectangular hole of the first beam component, into an open channel of second beam component; and e) fixing the assembly unit, preferably by bolting of lower and upper holes of said rectangular bracket with rectangular nuts, preferably inserted through appropriate rectangular holes of the beam components into corresponding opposite open channels of each of beam components to be connected, substantially in accordance with that shown in FIG. 5.

For obtaining three-direction joint the method of present invention further comprises:

f) setting a third beam component perpendicularly to an assembly unit of first beam and second beam components as connected and fixed in steps a)-e) aforementioned;

g) fitting a fashioned corner bracket into the open channels of both first beam and third beam components; and h) fixing said third beam to said first beam by means of said fashioned corner bracket, preferably by bolting with rectangular nuts, inserted through appropriate rectangular holes, into opposite open channels of each of beam components to be connected, substantially in accordance with that shown in FIG. 7.

In preferred way for obtaining up to six-direction joint the method of present invention further comprises:

i) setting a fourth beam component to the assembly unit as connected and fixed in steps f)-h) aforementioned in the opposite direction to first beam component;

j) fitting a second fashioned corner bracket into the open channels of both the third beam and the fourth beam components; and k) fixing said fourth beam to said third beam by means of said second fashioned corner bracket, preferably by bolting with rectangular nuts, inserted through appropriate rectangular holes on the fourth beam component to be connected;

l) setting a fifth beam component to the assembly unit as fixed in step k) in the opposite direction to third beam component;

m) fitting a third fashioned corner bracket into the open channels of both the fourth beam and the fifth beam components; and n) fixing said fifth beam to said fourth beam by means of said third fashioned corner bracket, preferably by bolting with a rectangular nut, inserted through appropriate rectangular hole, on the fifth beam component to be connected;

o) setting a sixth beam component to the assembly unit as fixed in step n) in the opposite direction to the second beam, to fit the upper part of said rectangular bracket, inserted through rectangular hole of the first beam into an open channel of the sixth beam; and p) fixing the assembly unit, preferably by bolting of the lower hole of said rectangular bracket with rectangular nut, inserted through appropriate rectangular hole in the sixth beam, and fixing the upper hole of said rectangular bracket by bolting it to the first beam with a square nut in the open channel of first beam component, substantially in accordance with that shown in FIG. 10.

In the method of connecting of beam components according to present invention any desired number of intermediate beam components can be attached in any of said six directions.

Present invention also covers nodal joint for technical construction, comprising beam components of present invention joined by fixing elements, where for two-direction joint it comprises assembly unit of two perpendicular beam components defined above, connected and fixed by means of rectangular bracket, preferably bolted with rectangular nuts, according to the method defined above.

Preferred embodiment of nodal joint for technical construction for three- to six-direction joint comprises beam components of present invention, joined by fixing elements, wherein an assembly unit of up to six perpendicular beam components defined above, are connected and fixed by means of rectangular brackets and fashioned corner bracket(s), preferably bolted with rectangular nuts according to the method of present invention for obtaining up to six-direction joint, substantially in accordance with that shown in FIGS. 7B-10B.

DETAILED DESCRIPTION OF THE EMBODIMENTS OF THE INVENTION

One of the main objects of present invention aims to provide a beam component(s) as shown in FIGS. 2-3, 5 and 7-11, being the main component of the kit for technical construction proposed. Beam component(s) 1-6 are preferably of I-beam (H-beam) type, however it can be also of T-beam or L-beam type etc. in some applications.

Figure 1:
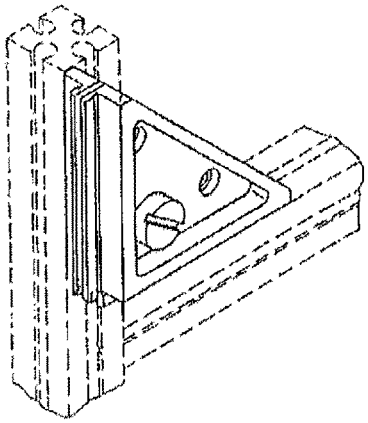
Fig.1 (PRIOR ART)
FIG. 1 is illustration of prior art for conventional connecting elements for technical constructions (prior art): A1—fixing element according to EP155451; A2—fixing element according to EP1441081, B—I-beam connection according to GB 1526058.
Figure 1:
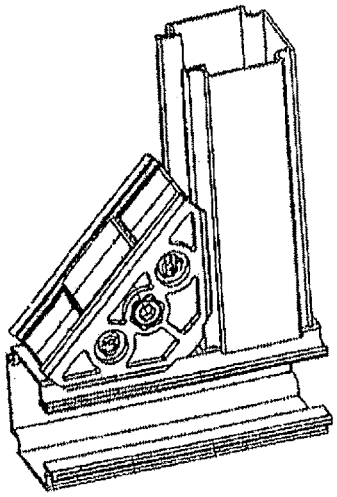
Fig.1 (PRIOR ART)
Figure 1:
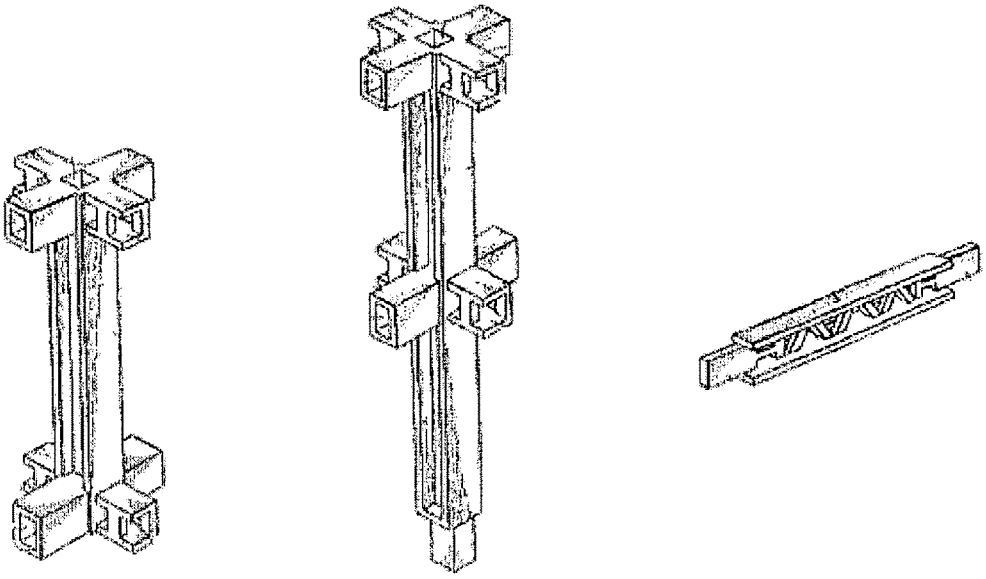
Fig.1 (PRIOR ART)
Figure 2:
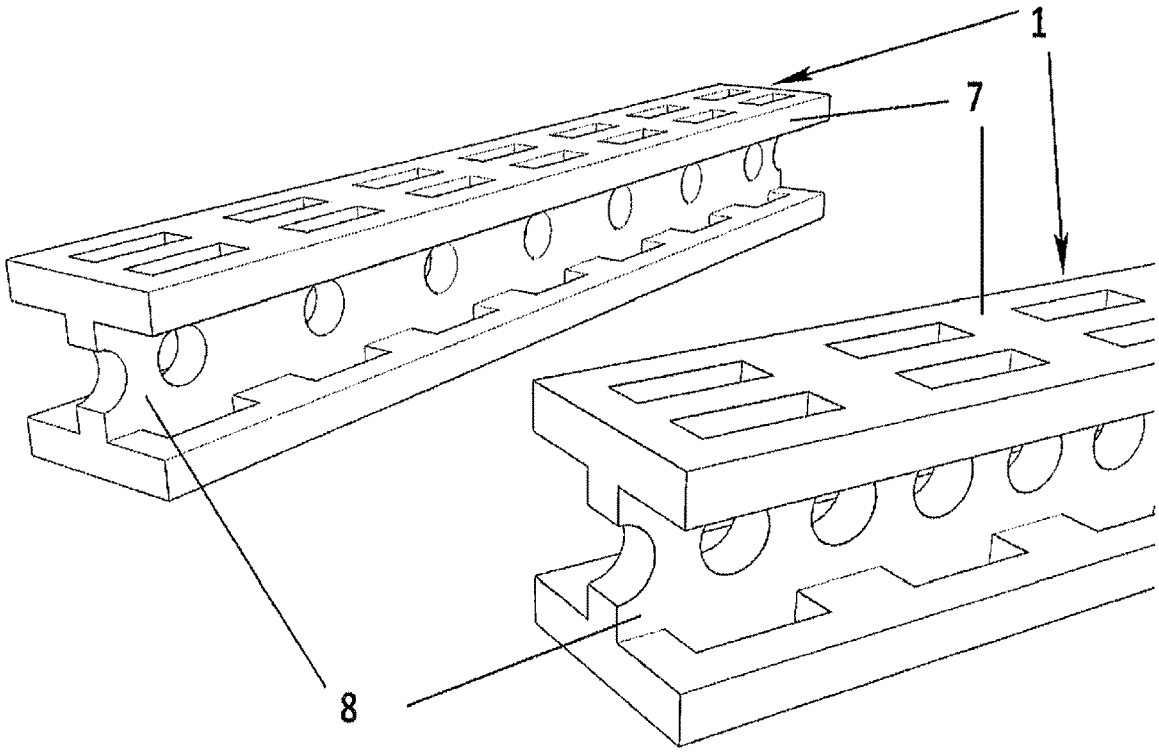
FIG. 2 shows the perspective view of beam component of present invention (left—with circular holes on the web, corresponding to the rectangular holes on the flange(s) of I-beam component; right—with additional intermediate circular holes on the web for possible further assembling).

In particular embodiment in FIG. 2 the I-beam is shown with a length of 70 relative units (for example 70 mm), but the length used can be in any modulus of 10 units. Thus lengths such as 10, 20, 30, 40 and so on can be used. The length units referred to are just relative units, the product can be manufactured with any suitable physical size.

The internal relative dimensions in the I-beam is designed in such a way that it is possible to join a number of I-beams together in one joint in all X,Y,Z axes directions, and combinations thereof.

Any number of intermediate beam components might be used if necessary to prolong the length.

If the builder needs an I-beam with a length not readily available, another longer I-beam can be cut down to the desired length.

Figure 3:
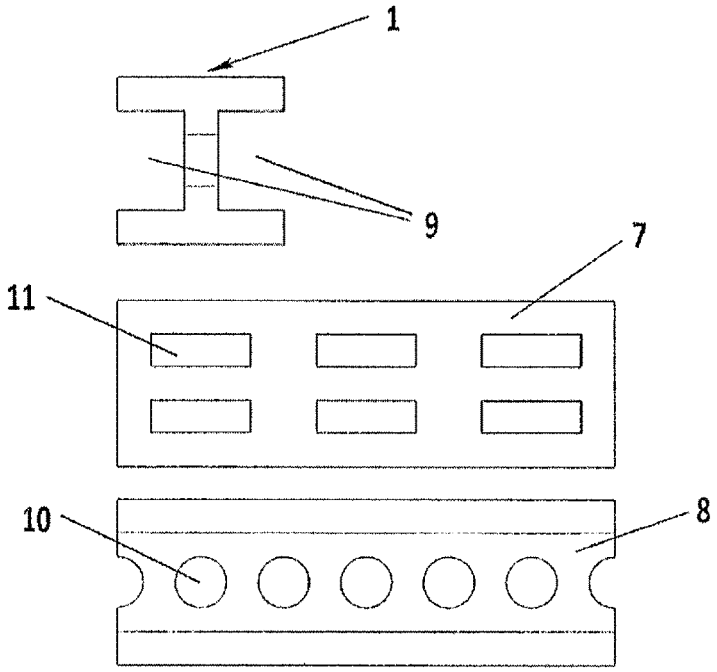
FIG. 3 represents side view, top view and front view of I-beam component, where relative proportions of the holes on beam component are shown.

The I-beam component comprises two flanges 7 and connecting web 8, forming two open channels 9 at both sides of a web (FIG. 2 and FIG. 3). In the preferred embodiment the flanges 7 represent an opposite sides of quadrate, connected in the middle by the web 8, the width of the flanges and the height of the beam being equal, for example, 10 relative units, and the thickness of the flange and of the web being equal, for example, 2 relative units. Circular holes 10 are done on the web 8, being evenly spaced, where the distance between centers of neighbouring circular holes 10 in the particular embodiment (FIG. 3) is 5 relative units. In this particular embodiment circular holes 10 will be used by mounting bolts with a diameter of 3 units. The holes 10 are preferably slightly larger than the bolts used, e.g. 3.1 units in diameter, to fit easily when assembling.

One or both flanges 7 of the beam are perforated with two lines of rectangular holes 11. In particular embodiment (FIG. 3) the dimensions of rectangular hole 11 are 2×6 relative units; a distance between two parallel lines of rectangular holes 11 is 2 relative units and this distance corresponds to the thickness of a web 8 relative units. Rectangular holes 11 in the particular embodiment are spaced by 4 relative units from each another.

The sectional dimensions of the open channel 9 in particular embodiment (FIG. 3) are 4×6 relative units.

The internal relative dimensions of each beam component 1-6 are designed in such a way that it is possible to join a number of I-beams together in one joint in all axes directions, and combinations thereof.

The open channel 9 is used for mounting fixing elements, namely brackets, nuts and bolts, as explained below. All these fixing elements are not protruding outside the limits of the open channel 9.

Any combination of joining the I-beams will have the same property to hide all the fixing elements.

A kit for technical construction according to present invention is containing a number of beam components, necessary for connection in up to six directions and forming the beam of desired length, and a corresponding number of special fixing elements, necessary to form and fix an assembly unit or nodal joint.

These fixing elements comprise rectangular brackets 12, fashioned corner brackets 14 and fastening element, which preferably are bolts 16 and nuts 17, 18.

Figure 4:
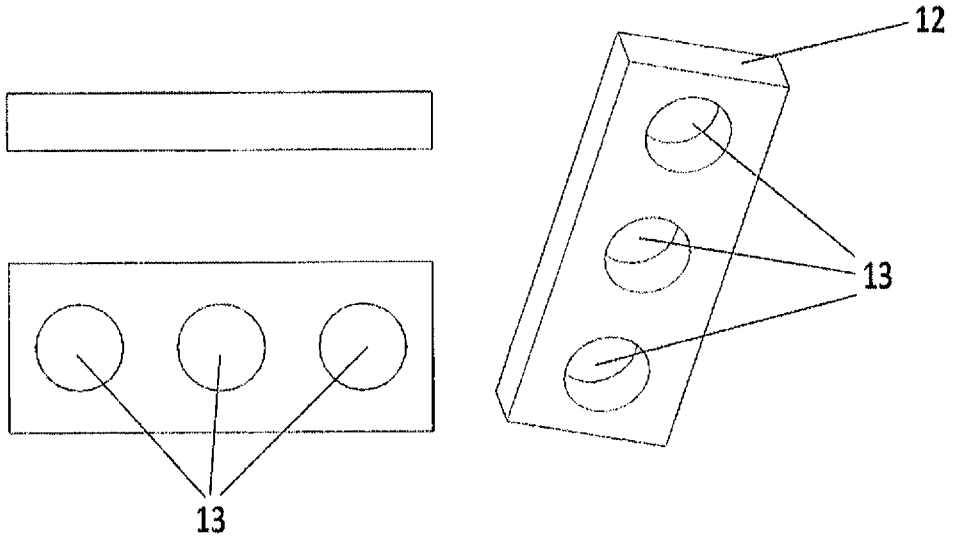
FIG. 4 is the views of rectangular bracket with circular holes.

Each rectangular bracket 12 is having at least two circular holes 13 at its ends. Particular embodiment is shown in FIG. 4, where rectangular bracket 12 has outer dimensions of 2×6×15 relative units and has three evenly spaced circular holes 13 for the bolts, wherein spacing and dimensions of circular holes 13 correspond to that of circular holes 10 on the web. Rectangular bracket 12 is designed to be inserted either through the rectangular holes 11 of the beam component or into the open channel 9 lengthwise. When placed via rectangular holes 11 it is fitting the space between both flanges 7; and when placed into the open channel 9 it will stay in place with the help of frictional fit, in both cases not protruding outside and to be further fixed via circular holes 13 (and through circular holes 10 of the web) with fastening elements.

Figure 5:
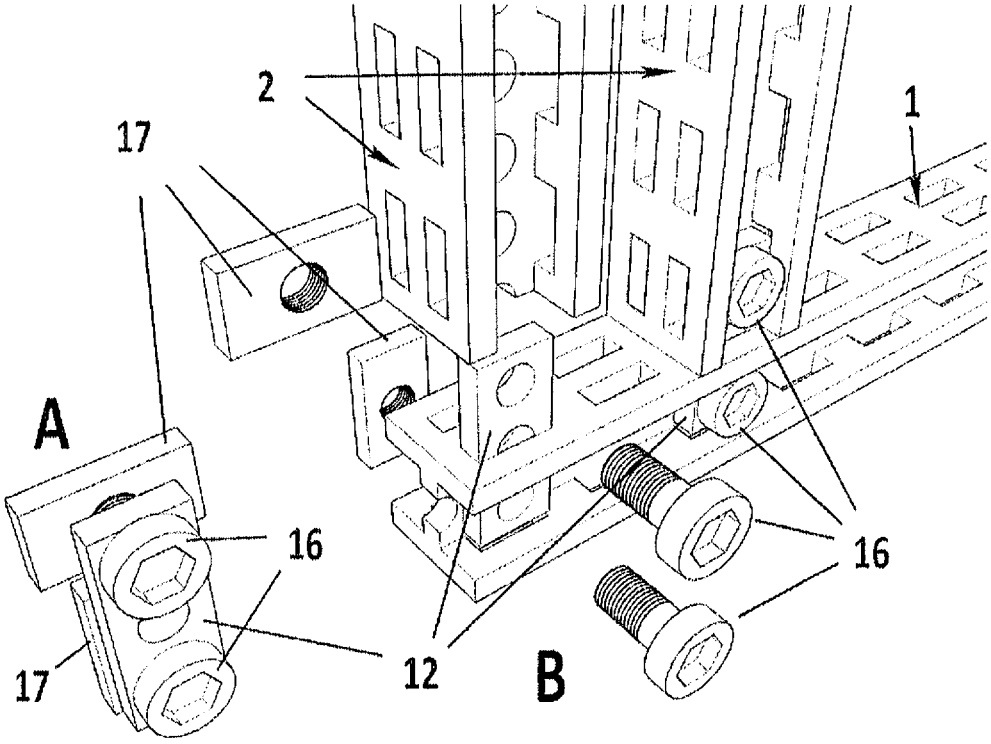
FIG. 5 shows how to use rectangular brackets to connect two I-beams perpendicularly.

A kit for technical construction necessary to connect and fix perpendicularly two I-beams is illustrated in FIG. 5 and besides two beam components mentioned comprises at least 1 pc rectangular bracket, 2 pcs rectangular nuts and 2 bolts.

Figure 6:
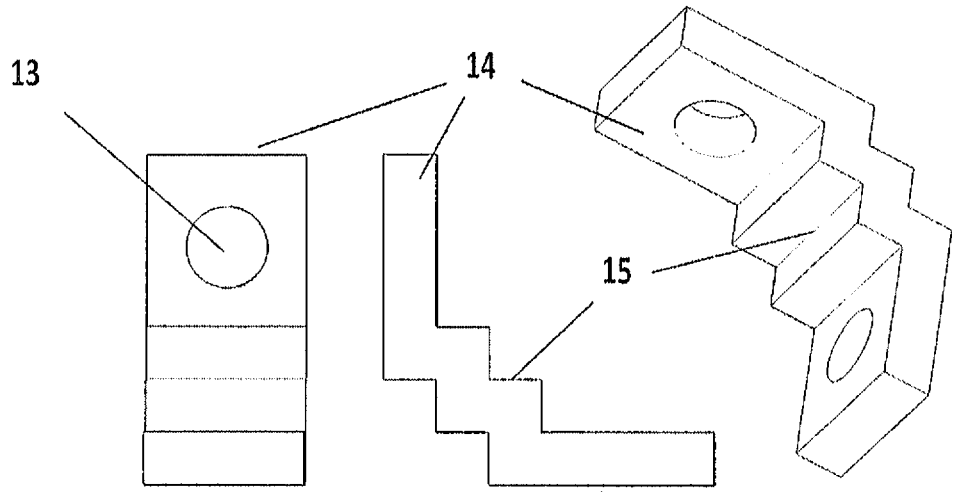
FIG. 6 is the views of fashioned corner bracket and relative proportions of its dimensions and holes.

Fashioned corner bracket 14 is step-shaped corner bracket, specially designed to hold the angle between the crossed I-beam being connected at 90°. It preferably comprises central corner part 15 of W/M profile and has circular holes 13 on its outer side edges, oriented perpendicularly as shown in FIG. 6. In the particular embodiment of present invention height-to-width aspect ratio in the central corner part 15 of W/M profile is 1:1:1:1. It has the same thickness of material as the thickness of the beams flanges and web. In the preferred embodiment of present invention this common thickness was designed to be 2 relative units (for example 2 mm) when beam faces are limited by 10×10 relative units (for example 10×10 mm); the steps of central corner part W/M profile being, for example, 2 mm, 2 mm, 2 mm etc.

The specific design of corner bracket 14 with W/M profile (all angles are right angles) of central corner part 15 ensures there will remain an inner space in the center of the nodal joint, inside the I-bream open channel. This inner space gives room for rectangular brackets 12 to be optionally inserted through rectangular holes 11. As well the space outside the end edges of fashioned corner bracket 14, mounted into open channel(s) of two crossed I-beams (FIG. 7 etc.) is sufficient to hide the head of bolt within the open channel of I-beam(s). Due to this special design, no part of the components will need to protrude outside the limits of open channel of the I-beams, being finally mounted into nodal joint.

Figure 7:
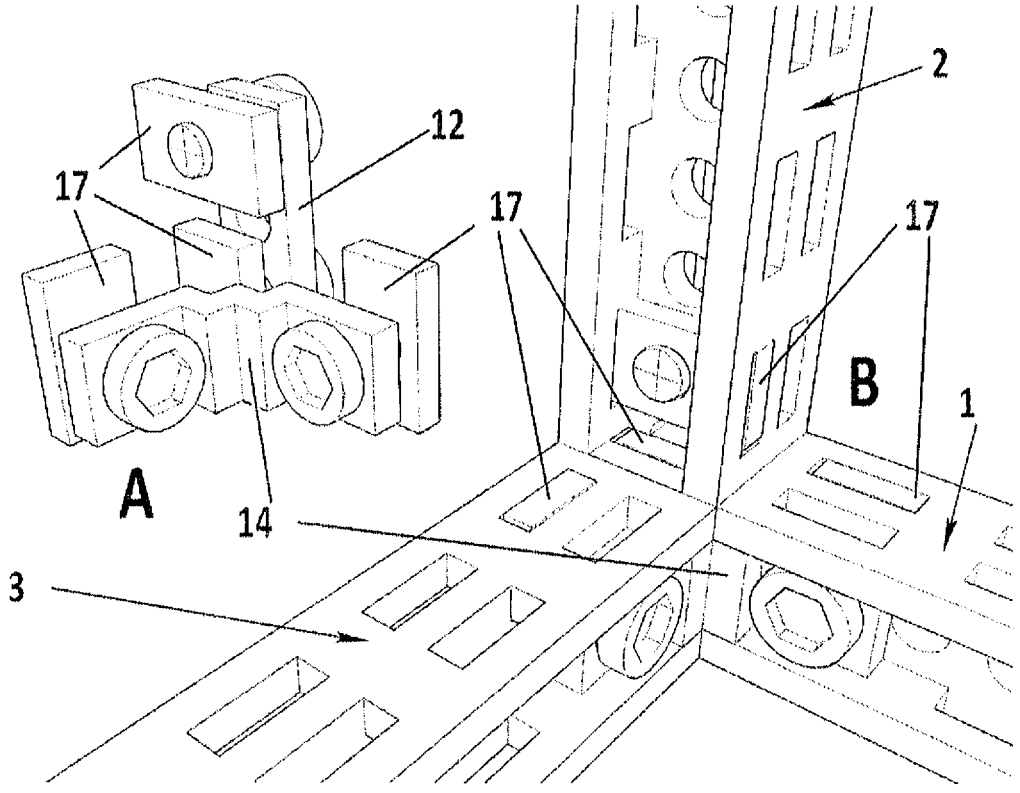
FIG. 7 shows (B) how to connect three I-beam components in 3 perpendicular directions, and (A) how to use fashioned corner bracket, rectangular brackets and nuts for fixing such nodal joint.
Figure 8:
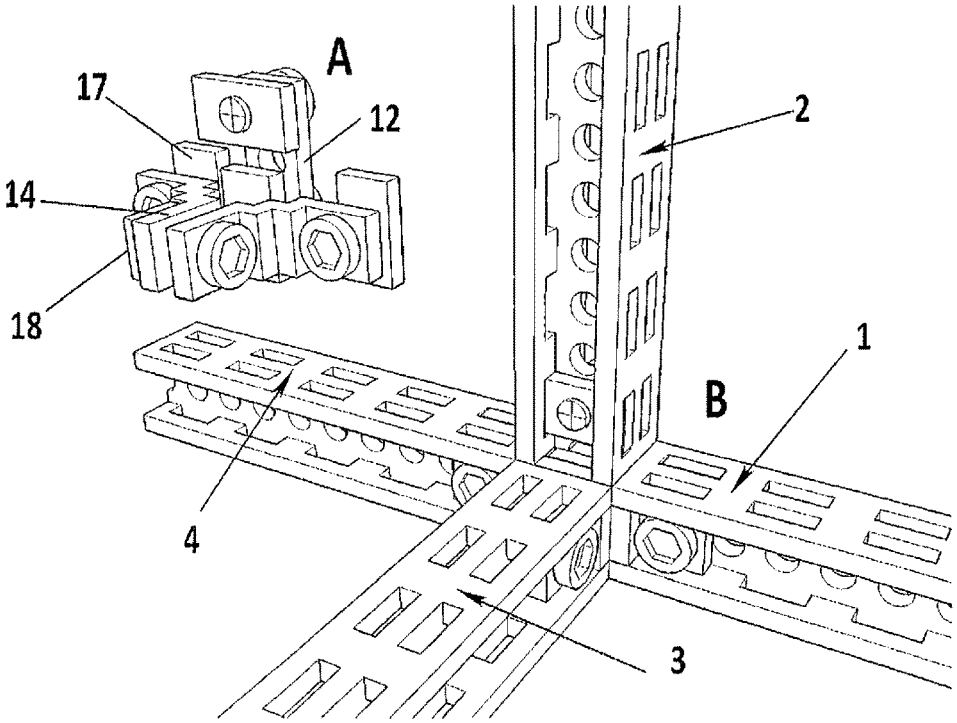
FIG. 8 shows (B) how to connect four I-beam components in 4 perpendicular directions, and (A) position of fixing elements for nodal joint of 4 beam components.

In FIG. 7 (A) the positions of all the fixing elements, necessary for joining of three I-beams perpendicularly, are shown. Such a construction kit, despite of three I-beam components, includes at least 1 pc fashioned corner bracket 14, 1 pc rectangular bracket 12, 4 pcs bolts diameter 3 and length 6 relative units and 4 pcs rectangular nuts 17.

Correspondingly the positions, orientation and all the fixing elements of the kit, necessary for method of connecting up to six I-beams perpendicularly are shown in FIG. 10(A). In this case for obtaining the nodal joint in up to 6 directions a construction kit, besides 6 I-beam components, includes at least 3 pcs fashioned corner bracket 14, 2 pcs rectangular bracket 12, 4 pcs bolts diameter 3 and length 6 relative units and 3 pcs bolts diameter 3 and length 8 relative units; 4 pcs rectangular nuts 17 and 3 pcs square nut 18.

Figure 11:
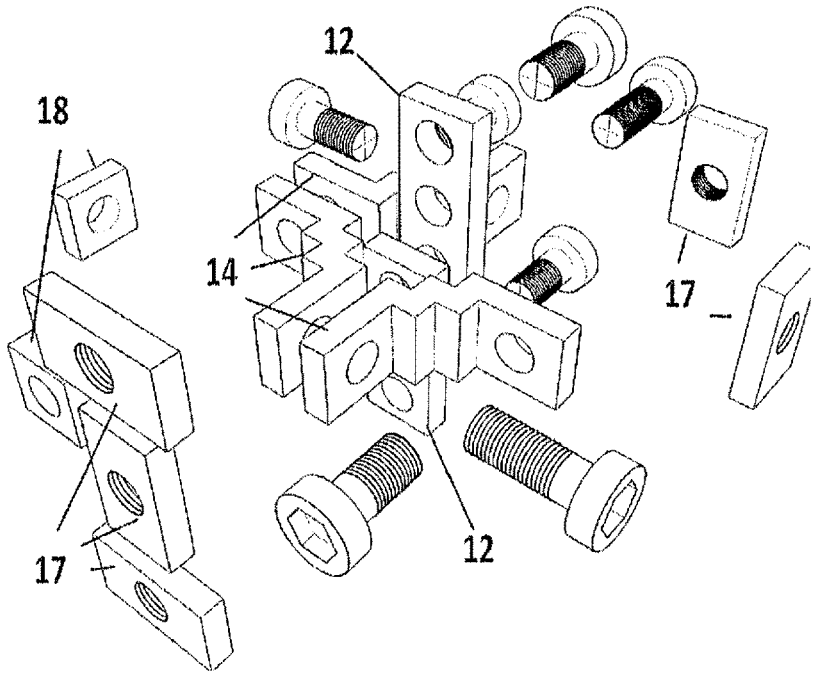
FIG. 11 shows the exploded view of fixing elements necessary to obtain nodal joint of up to six beam components according to present invention.

All fixing components mentioned are separately shown in FIG. 11 for illustration purpose. This kit comprises 2 square nuts 18. In the particular embodiment of present application the dimensions of these square nuts 18 are 5,5×5,5×2 relative units, while the dimensions of rectangular nuts 17 are 2×6×10 units. Each type of nuts has threads for a 3 unit diameter bolt. Specific dimensions of nuts 17,18 are to fit into open channels 9 of I-beam component(s) and being supported therein by friction, in order to stick in position and not fall out during the assembling.

The specific design of the rectangular 17 and square 18 nuts, fitting into the open channels 9 with a frictional fit, is important for the ease of fitting the components together. Loose nuts and brackets would have made them difficult to maneuver and hold in place before bolts are finally entered and fixed. Especially in small spaces and positions difficult to reach, said property will help building speed and ease of assembly.

The bolts 16 used are shown in FIG. 5 etc. In particular embodiment of present invention they have a diameter of 3 units and length of 6 units, not including the bolt's head height. Longer bolts are needed if further brackets are to be fixed by the same bolt.

As said above, the dimensions of the components are given relative, and can be manufactured in any desired physical size. The relative internal proportions must be kept, except the relative sizes of the holes for the bolts that can be adjusted for convenience. For these dimensions it may be preferable to find the closest standard for nut and bolt dimensions. This will make it possible to use existing nuts and bolts from other manufacturers.

The components mentioned can be produced with materials that are suited, depending of the strength and weight that is required in a given construction. For light weight purposes the I-beam can be made of a plastic material and the fixing components in aluminum. For applications needing a stiffer construction, the I-beam can also be made of metal.

Other properties like the material's electrical conductivity etc. may also decide what type of material will be best suited.

In a particular embodiment, the method of connection for obtaining two-direction joint as shown schematically in FIG. 5 comprises:

a) providing a kit as defined above, comprising two I-beam components 1,2 and at least 1 pc rectangular bracket 12, 2 pcs rectangular nuts 17 and 2 bolts.

b) putting a first beam component 1 on one of its flanges 7; alternatively the first beam component might not be putted onto any supporting surface (not shown on the drawings), but keeping in hands in corresponding orientation.

c) inserting a rectangular bracket 12 vertically through the frontal rectangular hole 11 of first beam component 1 into a position, wherein centers of lower circular hole 13 of said bracket 12 inserted and of a circular hole 10 in web 8 of said first beam component 1 match the same axis. The rectangular hole 11 might be selected at the end of beam component 1 or in the middle part thereof, depending on the structure planned to construct.

d) adding the second beam component 2 perpendicularly, facing the open channels 9 of both crossed beam components 1,2 to same side and forming an assembly unit, connecting said beam components at right corner by fitting the upper part of said rectangular bracket 12, inserted through a said rectangular hole 11 of the first beam component 1, preferably through lower frontal rectangular hole, into an open channel 9 of second beam component 2; and e) fixing the assembly unit, preferably by bolting of lower and upper circular holes 13 of said rectangular bracket 12 with rectangular nuts 17, preferably inserted through appropriate rectangular holes 11 of the beam component 2 into corresponding opposite open channel(s) 9 of each of beam components to be connected.

On the left side of FIG. 5 (B) one can see an exploded view of how the fixing rectangular brackets are mounted. There are 2 rectangular nuts 17 that fit into the rectangular holes on the flanges in the I-beams 1,2. Also shown is a rectangular bracket 12 fitting into the rectangular hole in the first (lower) I-beam 1, and also fitting lengthwise into open channel 9 of the second (upper) I-beam.

The method of connecting of beam components for obtaining three-direction joint is illustrated in FIG. 7. It comprises repeating of the steps a)-e) of connecting perpendicularly and fixing two I-beams as described above and further comprises the following additional steps:

f) setting a third beam component 3 perpendicularly to assembly unit of first beam 1 and second beam 2 components as fixed in step e) aforementioned;

g) fitting a fashioned corner bracket 14 cornerwise into the open channels 9 of both crossed first beam 1 and said third beam 3 components; and h) fixing said third beam 3 to said first beam 1 by means of said fashioned corner bracket 14, preferably by bolting with rectangular nuts 17, inserted through appropriate rectangular holes 11 into opposite open channel(s) 9 of each of beam components to be connected.

Figure 10:
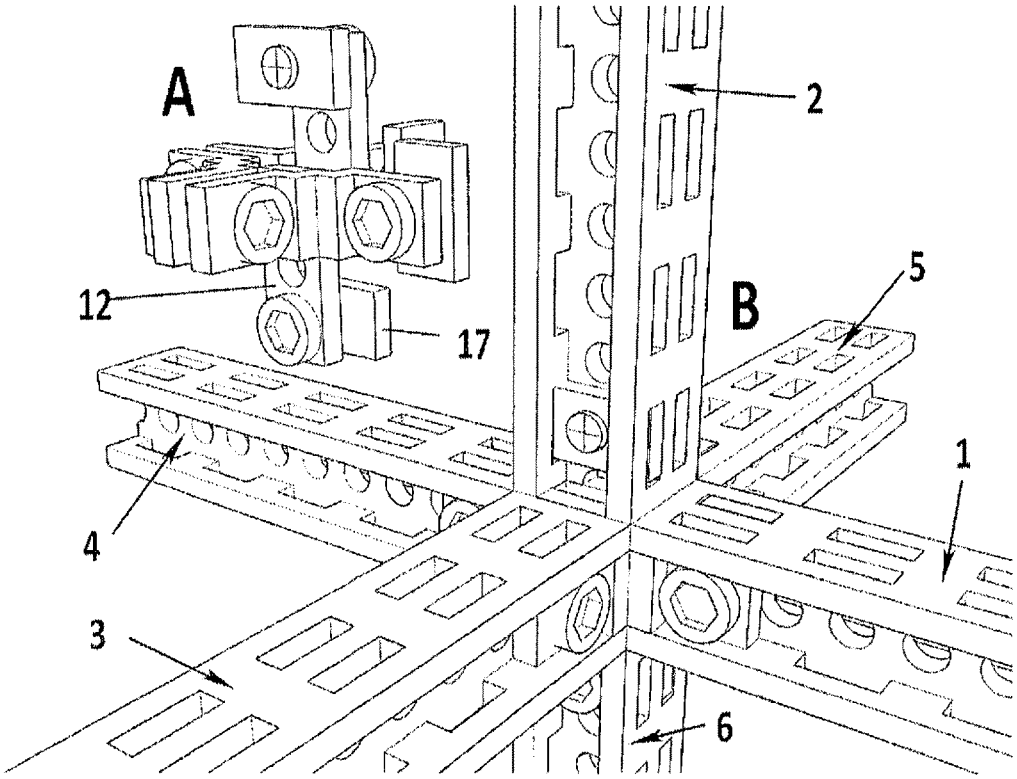
FIG. 10 shows (A) how to connect up to six I-beam components in 6 perpendicular directions, and (B) how to use a number of fashioned corner brackets and other fixing elements for nodal joint of up to 6 beam components.

The particular embodiment of method of connecting of beam components for obtaining up to six-direction joint is illustrated in FIG. 10. It comprises repeating of the steps a)-e) of connecting perpendicularly and fixing two I-beams as described above and steps f)-h) of adding third I-beam component and comprises the following additional steps:

i) setting a fourth beam component 4 to the assembly unit as fixed in step h) aforementioned in the opposite direction to first beam component 1;

j) fitting a second fashioned corner bracket 14 cornerwise into the open channels 9 formed of both crossed third beam 3 and the fourth beam 4 components; and k) fixing said fourth beam 4 to said third beam 3 by means of said second fashioned corner bracket 14, preferably by bolting with rectangular nuts 17, inserted through appropriate rectangular holes 11 on the fourth beam component 4 to be connected;

l) setting a fifth beam component 5 to the assembly unit as fixed in step k) in the opposite direction to third beam component 3;

m) fitting a third fashioned corner bracket 14 cornerwise into the open channels 9 of both crossed fourth beam 4 and the fifth beam 5 components; and n) fixing said fifth beam 5 to said fourth beam 4 by means of said third fashioned corner bracket 14, preferably by bolting with a rectangular nut 17, inserted through appropriate rectangular hole 11 on the fifth beam component 5 to be connected;

o) setting a sixth beam component 6 to the assembly unit as fixed in step n) in the opposite direction to the second beam 2, to fit the upper part of said rectangular bracket 12, inserted through rectangular hole 11 of the first beam 1 into an open channel 9 of the sixth beam 6; and p) fixing the assembly unit, preferably by bolting of the lower circular hole 13 of said rectangular bracket 12 with rectangular nut 17, inserted through appropriate rectangular hole 11 in the sixth beam 6, and fixing the upper circular hole 13 of said rectangular bracket 12 by bolting it to the first beam 1 with a square nut 18 in the open channel 9 of first beam component 1.

Any desired number of intermediate beam components can be attached longwise to prolong at least the horizontal beams for assembling wider frameworks, as for X-Y plotter, for example. Simply a rectangular bracket is inserted into open channels of beams to be joined butt to butt and bolted with rectangular nuts inserted from the opposite side of open channels.

A nodal two-direction joint, formed of two beam components of present invention, connected by fixing elements comprises assembly unit of two perpendicular beam components 1,2 connected and fixed by means of rectangular bracket 12, and bolted with rectangular nuts 17 as described in corresponding method above and shown on FIG. 5. Correspondingly each nodal joint for three- to six-directions is formed of up to six beam components of present invention, connected by fixing elements of present invention comprises an assembly unit of up to six perpendicular beam components 1-6 according to corresponding method described above, connected and fixed by means of rectangular brackets 12 and fashioned corner bracket(s) 14, preferably bolted with rectangular nuts 17 and square nuts 18.

The left side (A) of FIG. 7 shows all the fixing elements used for obtaining of nodal joint of three perpendicular I-beam components 1-3. On the right of FIG. 7 (B) the joint is shown assembled. No element is protruding outside the limits of open channels of I-beams 1-3 connected.

It is possible to obtain a nodal joint (4 directions) by adding the fourth I-beam component 4 to the assembly unit of 3 perpendicular beam components 1-3, connected and fixed as described above. Such nodal joint is shown on FIG. 8 (B). Additional second fashioned corner bracket 14, fitted cornerwise into open channels of both crossed beam components 3 and 4, is used. For fixing the latter additional rectangular nut 12 is bolted with 6 relative units bolt. Optionally one additional square nut 18 might be used bolted with 8 units bolt from the side of first fashioned corner bracket in assembling of four perpendicular beam components 1-4. The preferred way how to fasten all fixing elements to obtain nodal joint (4 directions) of present invention is shown on FIG. 8 (A). No element is protruding outside the limits of open channels of I-beams 1-4 connected.

Figure 9:
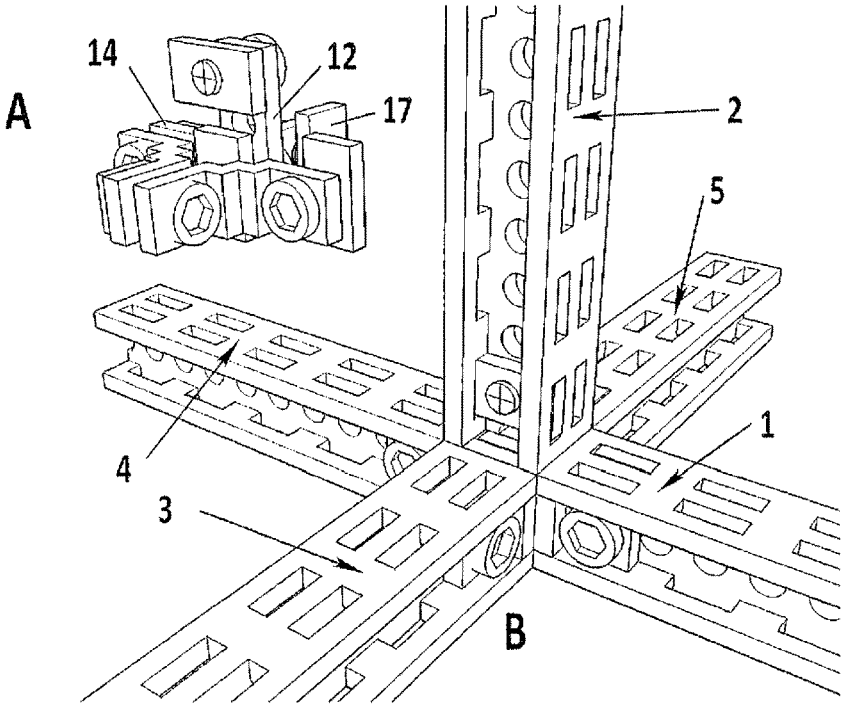
FIG. 9 shows (B) how to connect five I-beam components in 5 perpendicular directions, and (A) position of fixing elements for nodal joint of 5 beam components.

Correspondingly obtaining of nodal joint (5 directions) by adding the fifth I-beam component 5 to the assembly unit of 4 perpendicular beam components 1-4, connected and fixed into 4-direction nodal joint above is illustrated in FIG. 9. Additional third fashion corner bracket 14 is used, fitted cornerwise into open channels of both crossed beam components 4 and 5. For fixing the latter additional rectangular nut 12 is bolted with 6 relative units bolt. Optionally one additional square nut might be used bolted with 8 units bolt from the side of second fashioned corner bracket in assembling of five perpendicular beam components 1-5. The preferred way how to fasten all fixing elements to obtain nodal joint (5 directions) of present invention is shown on FIG. 9 (A). No element is protruding outside the limits of open channels of I-beams 1-5 connected.

In particular embodiment on FIG. 10 (A) one can see how the fixing elements are connected analogously to the aforementioned to form and fix the nodal joint of six perpendicular I-beam components. FIG. 11 illustrates exploded view of all fixing elements to be used in particular embodiment for obtaining nodal joint of up to six perpendicular directions.

On the right of FIG. 10 (B) the nodal joint of 6 I-beam components is shown assembled. No element is protruding outside the limits of open channels of I-beams 1-6 connected.

The present invention is explained above referring to the preferable embodiments thereof, and drawings. It should be understood that these references are not limiting the scope of the invention and other variations and permutation in connecting of large amount of components and elements are possible without departing from the scope of present invention and clear for the skilled persons from the current description, drawings and Claims. All such variations to be considered covered by the scope of present invention.

ADVANTAGES OF PRESENT INVENTION AND INDUSTRIAL APPLICABILITY

To the best of inventor's knowledge, the present invention differs from the known prior art essentially at least by the special design of beam component and fashioned corner bracket as well as by method of connection of beam components.

Correspondingly present invention enables the central I-beam-components to be connected with special brackets in a joint with an arbitrary number of axes, ranging from 2 up to 6 directions, ensuring an enduring and strong way of joining.

The invention emphasizes the ease of how to build, and specifically that it is not difficult to build where models get small and with tight areas. Moreover, the design of main components proposed ensures a user friendly and simple handling and building technique. The product essentially gives a framework to fasten and mount electronic or mechanical components in a durable construction. When compared to friction and snap hold methods, the presented invention can withstand harder loads and strains than existing construction kits have been able to offer.

The minimal amount of details is used to achieve same endurance.

With simple brackets and bolts and nuts a durable and rigid construction is obtained, fixing components being fixed with bolts and nuts into the web, thus the center of the beam. The fashioned corner bracket has W/M center that relieves forces in the bracket corner. It also gives further support to the strength that the fixing brackets and nuts fits tight into the rectangular holes in the beams. This makes a good distribution of forces in the combined joining when exposed to twist and bends.

Due to the inherent geometry of the I-beam, one can easily and compactly add brackets to hold electronics modules and other systems components. Further the invention frees space around the joining hubs (nodal joints) so it is possible to come close to joints with either other I-beams or fixing other construction components in close proximity to joints and each other. On the other side, the method of assembly and the geometry of the I-beam and fixing components of present invention allow the receiving nuts to be placed inside the I-beam and stay put before the I-beams are further fixed to another I-Beam or into a larger construction. The bolts, which can be magnetic, will be inserted with a magnetic screwdriver, thus the constructor can use one hand holding fixing components, before entering the bolt with the other hand.

And further the product can be used to build models with movable parts.

Since the constructions made by the invention has an inherent strength, it can be used for making models with moving parts, like building vehicles, robots, industrial activators and production equipment.

Figure 12:
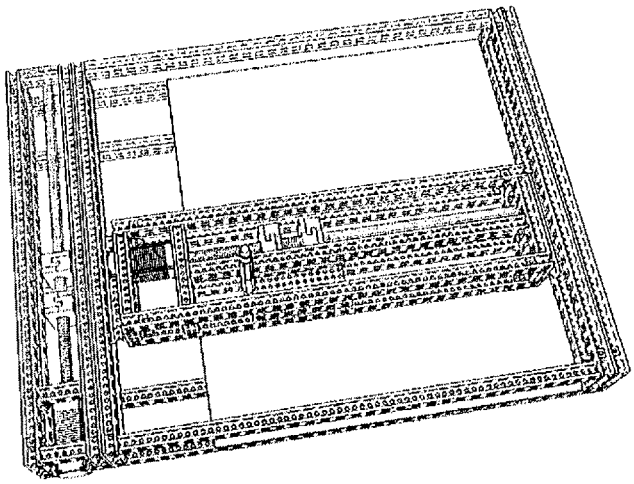
FIG. 12 illustrates examples of products of technical constructions according to present invention, A—framework for XY-plotter; B—framework for electronics learning kit; C—framework for chess-playing robot.
Figure 12:
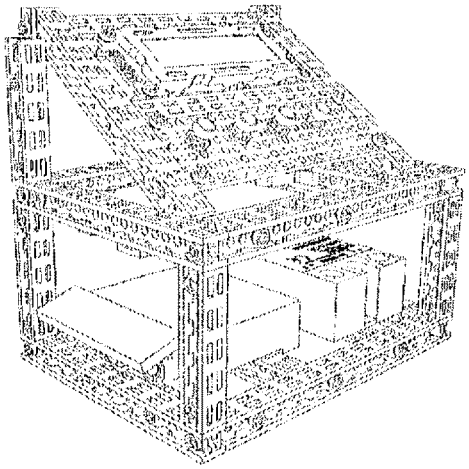
Figure 12:
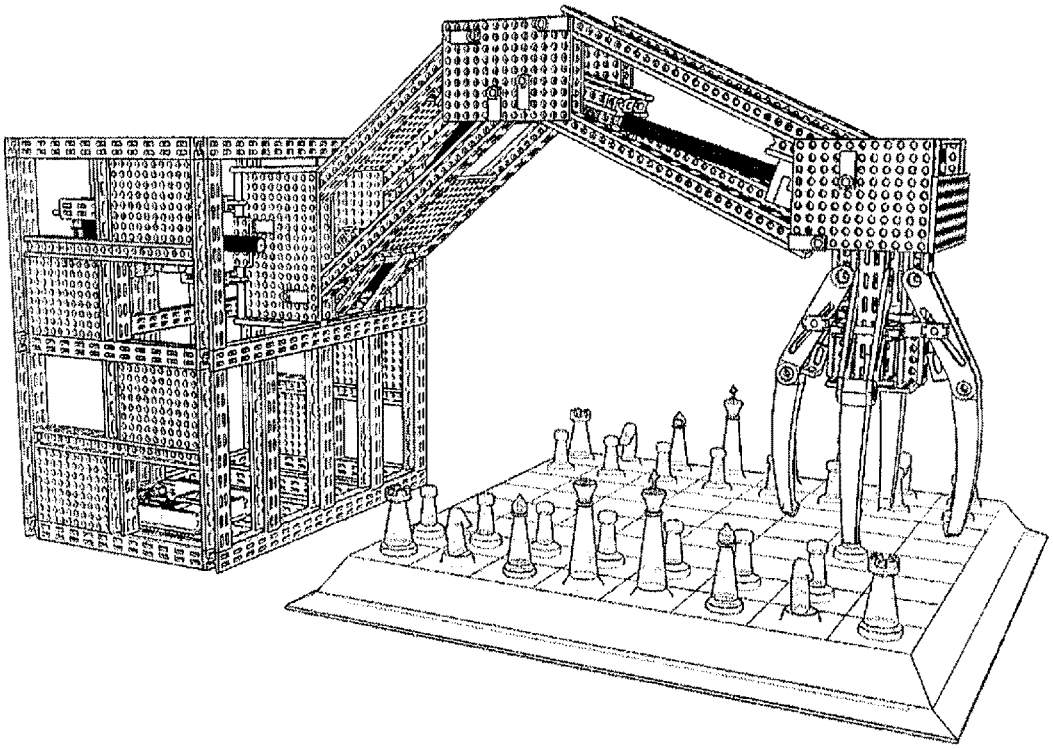

Some samples of the products, constructed according the present invention are shown in FIG. 12.

The method of present invention is protected by trademark "mechduino" (Norwegian trademark Reg. No. 279245).

LIST OF POSITIONS

1-6—beam components;
7—flange of beam component,
8—web of beam component;
9—open channel of beam component;
10—circular hole(s) on web;
11—rectangular holes on flange;
12—rectangular bracket (fixing element);
13—circular hole(s) on rectangular bracket or on the fashioned corner bracket;
14—fashioned corner bracket (fixing element);
15—W/M profiled central corner part of fashioned corner bracket;
16—bolt(s);
17—rectangular nut(s);
18—square nut(s).

What is claimed is:

1. A beam component for use in technical construction, comprising two opposing flanges connected along a longitudinal center line by a web delimiting an open channel on both sides of the web, wherein the beam component is a one-piece element, wherein the web is perforated with evenly spaced circular holes, wherein each of the two opposing flanges is perforated with at least two parallel lines of longitudinal rectangular holes disposed on opposing sides of the web extending from the longitudinal center line of the flange and having an inner boundary edge delineated by a surface of the web, and wherein the ratio of the thickness of a flange and depth and width of the open channel is 1:2:3.

2. The beam component according to claim 1, wherein a distance between the at least two parallel lines of rectangular holes corresponds to the thickness of the web.

3. The beam component according to claim 1, wherein the longitudinal rectangular holes are spaced along a flange so that a center of each longitudinal rectangular hole is aligned with the center of a circular hole on the web.

4. The beam component according to claim 1, further comprising a step-shaped bracket with a W/M profiled central corner part and two end parts perpendicularly positioned with respect to the central corner part, each end part perforated with a circular hole, the step-shaped bracket designed to fit into open channels of the beam component and to fix together two perpendicularly crossed beam components.

5. The beam component according to claim 1, wherein the two parallel lines of longitudinal rectangular holes in the two opposing flanges of the beam component are aligned.

6. The beam component according to claim 1, further comprising a rectangular bracket, the rectangular bracket designed to fit in the rectangular holes in the two opposing flanges.

7. The beam component according to claim 1, further comprising a rectangular bracket, the rectangular bracket designed to fit in the open channel formed between the two opposing flanges.

8. The beam component according to claim 1, further comprising a rectangular bracket having at least one circular hole with dimensions corresponding to dimensions of a circular hole in the web.

9. The beam component according to claim 8, further comprising a mounting bolt to secure the rectangular bracket when the at least one circular hole in the rectangular bracket is aligned with the circular hole in the web.

* * * * *